US005199935A

United States Patent [19]

Gibson et al.

[11] Patent Number: 5,199,935

[45] Date of Patent: Apr. 6, 1993

[54] MOLDED TOP WEIGHT

[75] Inventors: Ronald S. Gibson, Valencia; Theodore G. Habing, Long Beach, both of Calif.

[73] Assignee: Pacific Fitness Corporation, Cypress, Calif.

[21] Appl. No.: 862,295

[22] Filed: Apr. 2, 1992

[51] Int. Cl.[5] ..... A63B 21/062

[52] U.S. Cl. ..... 482/98

[58] Field of Search ..... 482/98-103, 482/93, 104, 133, 135-139, 148

[56] References Cited

U.S. PATENT DOCUMENTS

| | | | |
|---|---|---|---|
| 3,758,109 | 9/1973 | Bender | 482/93 |
| 4,357,011 | 11/1982 | Voris | 482/139 X |
| 4,361,323 | 11/1982 | Segerstein | 482/102 |
| 4,601,466 | 7/1986 | Lan | 482/99 |
| 4,712,793 | 12/1987 | Harwick et al. | 482/99 |
| 4,787,628 | 11/1988 | Harwick et al. | 482/98 |
| 4,878,662 | 11/1989 | Chern | 482/98 |

*Primary Examiner*—Robert Bahr

*Attorney, Agent, or Firm*—Blakely, Sokoloff, Taylor & Zafman

[57] ABSTRACT

A top weight adapted for vertical adjustment when disposed at the top of a weight stack in a suspended weight exercise machine having guide rods on which the weight stack slides, and a central pick-up rod which engages the weight stack for suspension thereof. The top weight includes a plurality of cavities open at the bottom to permit installation of insert weight plates therein. A slot opening extending through the entire width of the top weight permits vertical adjustment of the central pick-up rod when the top weight is mounted thereto along a vertical direction. This vertical adjustment accommodates manufacturing tolerances in the weight stack which would otherwise prevent a selector pin from interconnecting the weight stack to the central pick-up rod.

8 Claims, 2 Drawing Sheets

MOLDED TOP WEIGHT

BACKGROUND OF THE INVENTION

1. Field of the Invention

The present invention relates to weights for a suspended weight exercise machine. More precisely, the present invention relates to a top weight adapted to mount on the top of a weight stack in the suspended weight exercise machine.

2. Description of the Prior Art and Related Information

There is a wide array of exercise machines for use in gyms and other exercise centers. One group of exercise machines employs a set of weights lifted in response to manual force exerted by a user undertaking a muscular exercise regimen. These exercise machines rely on suspended weight to provide the resistance against which the user must exert muscular force. The suspended weights are arranged in a weight stack comprised of individual weight plates. The entire weight stack slides up and down along guide rods anchored to the exercise machine. A central pick-up rod is inserted vertically down through aligned holes formed coaxially in each weight plate of the weight stack. Each weight plate has a side hole or slot running perpendicular to the vertical hole and in communication therewith. To set the weight resistance, the user inserts a locking pin through the side hole, which pin then passes through the hole in the pickup rod thereby locking the pick-up rod to the stack of weight. Obviously, inserting the locking pin further down in the weight stack results in a heavier weight resistance that is experienced by the user. A cable at the top of the pick-up rod passes through a series of pulleys and is eventually secured to an exercise member. Thus, the user can move the exercise member to pull on the cable, and accordingly to lift the stacked weights upwards thus suspending the stacked weights against the force of gravity. As the user reciprocates the exercise member through an exercise regimen, the suspended weights are correspondingly moved up and down along the guide rods.

To maintain the individual weight plates together on the weight stack, and to stabilize the pick-up rod to ensure that it stays relatively vertical during the vertical reciprocating motion of the suspended weights, most exercise machines incorporate a top weight that rests on top of the weight stack. The top weight is secured to the pick-up rod, but is free to slide along the guide rods in unison with the suspended weights.

Because of manufacturing tolerances in the weight stack, fitting the top weight to the weight stack and aligning all the holes are often difficult operations. This increases fabrication costs of the exercise machine. Moreover, a sloppy fit causes rattling when the weights are used. The rattling noise is annoying to many users. Accordingly, a need presently exists for a top weight that is versatile and easily adaptable to the weight stack.

At least one prior art exercise machine employs a top weight that has a molded shell and a steel weight inserted therein. Furthermore, at least one other prior art exercise machine employs a top weight that is coupled to the pick-up rod by means of a pair of threaded studs that pass through a plate secured to the top of the pick-up rod. The position of the pick-up rod with respect to the top weight may thus be adjusted vertically by varying the vertical position at which the plate is secured to the studs. Such prior art devices, however, do not offer all of the features and benefits of the invention hereinafter described.

SUMMARY OF THE INVENTION

The present invention relates to a top weight that has a vertical adjustment feature and can accommodate a variety of insert weights. Specifically, the top weight is disposed at the top of a weight stack in a suspended weight exercise machine having guide rods along which the weight stack slides, and a central pick-up rod which engages the weight stack for suspension thereof. In a preferred embodiment, the present invention top weight is comprised of a body molded from plastic having two bulbous sections interconnected by an intermediate portion, wherein the body has a plurality of open cavities. The cavities inside the body are open to the outside at the bottom of the body. A central sleeve is disposed in the intermediate portion and extends vertically therethrough placing the top of the body in communication with the bottom. Similarly, two bearing tubes each disposed in the respective bulbous section extend vertically through the section and places the top of the body in communication with the bottom. On either side of the central tube is disposed a weight plate. The weight plate preferably has a rectangular shape and is made from steel. The variety of cavities in the body are designed to receive other weight plates if necessary.

A vertical slot opening is formed into the side wall of the intermediate portion creating a passage through the walls, weight plates and the central sleeve. During assembly, the top weight is placed at the top of the weight stack such that both guide rods slide through the bearing tubes disposed in the bulbous sections and the central pick-up rod passes through the central sleeve. A stud or pin is then inserted through the slot opening and passes through a hole in the pick-up rod. The pick-up rod is thus locked or secured to the top weight.

The present invention provides several advantages over the prior art. First, extra weights of varying sizes and mass can be inserted into the network of open cavities in the body of the top plate. This allows the overall weight of the top plate to be customized. Indeed, various exercise machines use different cable and multiple pulley arrangements with different pick-up rod lengths, which require varying amounts of counterbalancing that the top plate must perform. By varying the actual weight of the top weight, the effective weight of the top weight system, which includes various lengths of the pick-up rod, can be held at an optimum level. Accordingly, only one molded top weight, assembled in combination with a variety of insert weight sizes, can be used with many different exercise machines having many different cable pulley and pick-up rod configurations. This degree of versatility in the top weight substantially eases manufacturing and assembly effort.

Second, the vertical slot opening through the side of the top weight permits last minute adjustment during assembly. That is, when a bolt or pin is inserted through the top weight body and the pick-up rod, the bolt ensures that the insert weight plates cannot inadvertently fall out. A unique aspect of the slot opening design is that it allows the bolt, and therefore the pick-up rod, to be adjusted up or down relative to the top weight. This allows the relative distance between the top plate and the multiple holes in the pick-up to be varied.

The adjustment feature is important since the top weight assembly fits onto a stack of cast iron weight plates. In many exercise machines, there can be as many as 25 individual weight plates stacked together in a column. Because the foundry process for cast iron yields individual plates of various thickness with large tolerances, stacking a large number of weight plates in a single column becomes difficult in prior art devices since the variations in dimensions may not allow specific holes to align. Thus, it is sometimes difficult to insert the selector pin through the stacked weights to lock the latter to the pick-up rod.

In the present invention, however, by having the top plate and accordingly the pick-up rod adjustable vertically, the varying thickness dimensions of the weight stack can be accommodated by sliding the bolt within the slot opening. Accordingly, the present invention top plate is easily adapted to varying weight stacks and maintains a rattle free stack when properly adjusted.

It is therefore an object of the present invention to provide a top weight having a plurality of cavities to receive insert weight plates for counterbalancing purposes. It is another object of the present invention to provide a top weight featuring a vertical slot opening through the side to provide vertical adjustment capability of the pick-up rod relative to the stacked weights. It is yet another object of the present invention to provide a top weight that is easily assembled and can be adapted to a variety of weight stacks and exercise machine configurations.

DETAILED DESCRIPTION OF THE INVENTION

In the following description, for purposes of explanation and not limitation, specific numbers, dimensions, materials, etc. are set forth in order to provide a thorough understanding of the present invention. However, it will be apparent to one skilled in the art that the present invention may be practiced in other embodiments that depart from these specific details. In other instances, detailed descriptions of well known mechanical elements are omitted so as to not obscure the description of the present invention with unnecessary detail.

The present invention relates to a top weight disposed at the top of a weight stack in a suspended weight exercise machine having guide rods on which the weight stack slides, and a central pick-up rod which engages the weight stack for suspension thereof. In particular, the present invention top weight has an adjustment feature to accommodate manufacturing tolerances of the weight stack; and has a network of chambers to receive insert weights for counterbalancing purposes.

Figure 1:
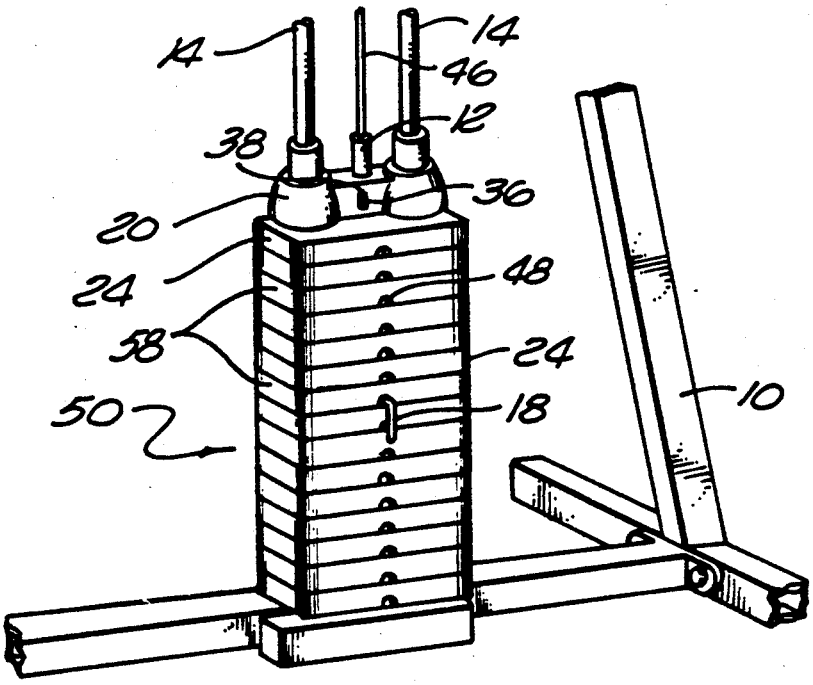
FIG. 1 is a perspective view of a weight stack for a suspended weight exercise machine.

FIG. 1 provides a perspective view of a preferred embodiment of the present invention top weight as it is situated atop a weight stack of a suspended weight exercise machine. As seen in the drawing, the top weight 20 rest on top of a stack of weight plates 24 arranged in a column. Collectively, the column of weight plates 24 is referred to as weight stack 50. The weight stack 50 is designed to slide up and down along twin guide rods 14 that are anchored to the exercise machine 10. Each weight plate 24 has a hole extending vertically therethrough; so when the weight plates 24 are arranged in a stack 50, the holes are aligned coaxially and form a vertical tunnel. The tunnel is intended to receive a central pick-up rod 12. To that end, the tunnel provides clearance to the central pick-up rod 12 to be lowered to any depth in the weight stack 50.

The central pick-up rod 12 is attached to a cable 46 at one end and has a series of holes disposed uniformly along its length. As is known in the art, the pick-up rod 12 is used to interconnect the weights 24 with the cable 46.

Each weight plate 24 has a selector pin hole 48 formed through its side to receive a selector pin 18. As is known in the art, a user of the weight machine 10 can then select the amount of resistance by choosing the number of weight plates 24 to be lifted. In FIG. 1, a total of seven weight plates 24 are used to supply the resistance. The selector pin 18 is inserted through selector pin hole 48 and engages a corresponding hole in the central pick-up rod 12 thereby locking the latter to the former. A cable 46 at the top of the central pick-up rod 12 is attached to a pulley system and connects with an exercise member. Therefore, displacing the exercise member causes the cable 46 to lift the seven plates 24 off of the weight stack 50. Weight suspension exercise machines of this type are well-known in the art so no further discussion regarding their operation is necessary.

Figure 2:
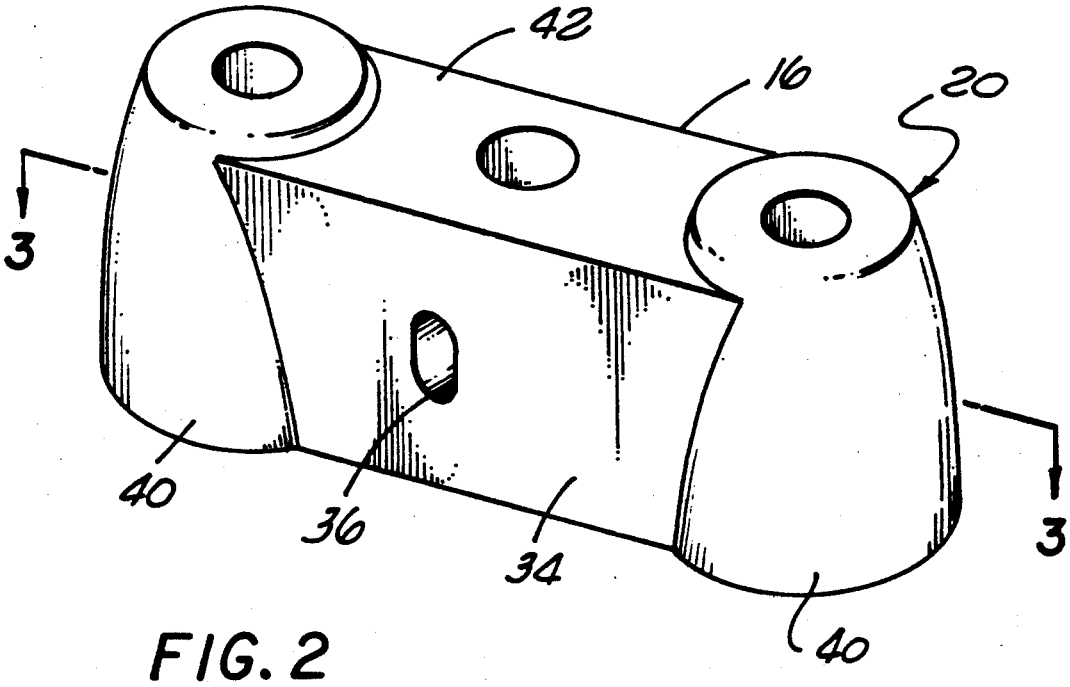
FIG. 2 is a perspective view of the present invention top weight.

The top weight 20 is necessary in order to provide a guide rod bearing for the pick-up rod and to counterbalance the weight of the cable and pulley system (not shown) so that the pick-up rod will not fly upwardly when selection pin 18 is removed. FIG. 2 provides a perspective view of a preferred embodiment of top weight 20. In the overall configuration, the top weight 20 is comprised of twin bulbous sections 40 interconnected by an intermediate portion 42. A vertically elongated slot opening 36 is provided in the side wall 34 of the body 16 of the top weight 20.

Figure 3:
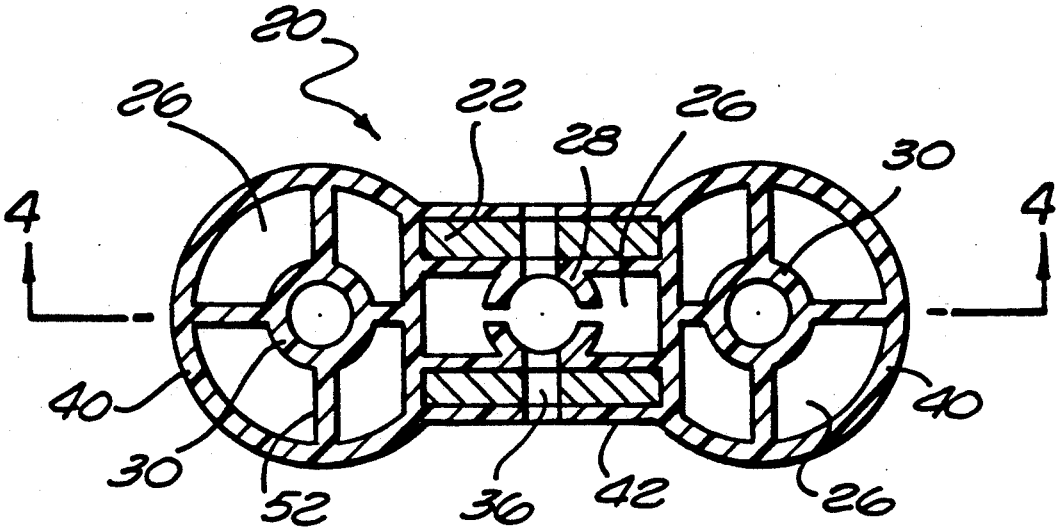
FIG. 3 is a cross-sectional view of the top weight taken along line 3—3 of FIG. 2.

FIG. 3 is a sectional view of the top weight 20 taken along line 3-3 of FIG. 2. In this sectional view, the various open cavities 26 are shown along with the positioning of a central sleeve 28 in the intermediate portion 42 and a pair of guide rod bearing tubes 30 located in the respective bulbous sections 40. On either side of the central sleeve 28 is an insert weight plate 22. It should be noted here that the slot opening 36 shown in FIG. 2 forms a continuous passage through the intermediate portion 42. The guide rod bearing tubes 30 are preferably circular and are braced by webs 30; likewise, the central sleeve 28 also has a circular cross section. Of course, other configurations of internal cavities and web braces are possible.

Figure 4:
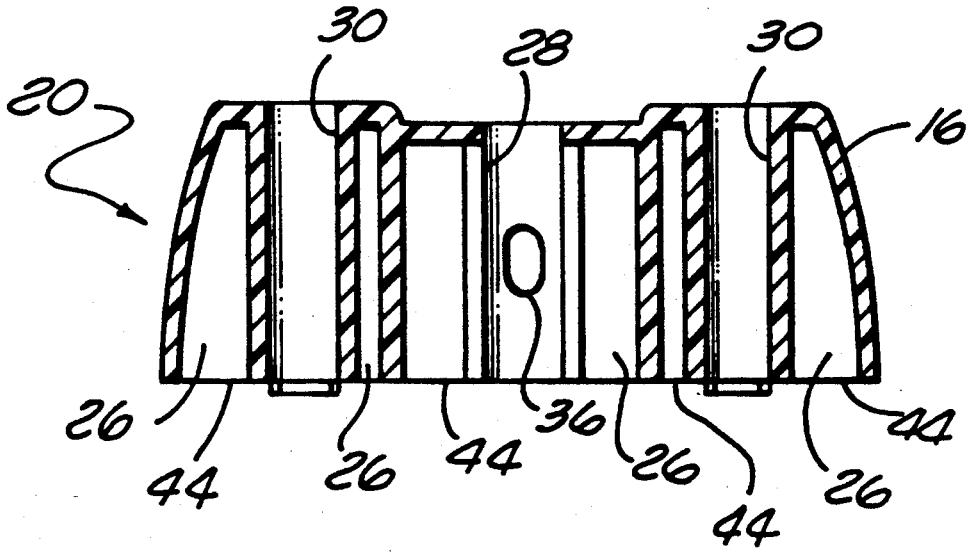
FIG. 4 is a cross-sectional view of the top weight taken along line 4—4 of FIG. 3.

FIG. 4 provides a cross-sectional view of the preferred embodiment of top weight 20 taken along line 4-4 of FIG. 3. This view clearly depicts the open cavities 26 formed throughout the interior of the body 16. Each open cavity 26 has a respective bottom opening 44. Also seen in this view are the guide rod bearing tubes 30 that extend vertically through the entire height of the body 16. Likewise, central sleeve 28 extends the entire height of the intermediate portion 42. The slot opening 36 which has a vertical elongation is shown also.

The body 16 of the top weight 20 can be made from a polymer such as nylon. Of course, other materials known in the art are also suitable. Furthermore, the internal open cavities 26 of the body 16 can be formed into various shapes and sizes to accommodate insert weight plates 22 of varying shapes and sizes. Preferably, the overall weight of the top weight 20 with the insert weight plates 22 in place ranges from 5 to 8 pounds. As mentioned above, a higher or lower overall weight can be achieved by inserting additional weight plates or removing or resizing the insert weight plates.

During assembly, the various open cavities 26 can be used to hold insert weight plates 22. Since the open cavities 26 have open bottoms 44, additional insert weight plates 22 can be conveniently added to or removed from the body 16. Typically, an interference fit between the insert weight plate 22 and the walls of cavity 26 is sufficient to hold the insert weight plate 22 therein. Regarding the primary insert weight plates 22 as shown in FIG. 3, the slot opening 36 extends therethrough so that when a locking pin or bolt 38 is inserted, as shown in FIG. 1, the bolt 38 holds the insert weight plates 22 inside the body 16.

FIG. 1 best illustrates assembly of the top weight 20 to the exercise machine 10. Here it can be seen that the guide rod bearing tubes 30, shown in a cross-section in FIG. 4, are adapted to receive the guide rods 14 of the exercise machine 10. Likewise, the central sleeve 28 shown in a cross-section in FIG. 4 is adapted to receive the central pick-up rod 12. The slot opening 36 in the body 16 when aligned with a corresponding hole in the pick-up rod 12 permits insertion of a locking pin or bolt 38 therethrough, as seen in FIG. 1. In that manner, the top weight 20 is locked to the central pick-up rod 12. Lifting on the cable 46 lifts the top weight 20 causing the latter to slide along the guide rods 14.

As mentioned earlier, the lower end of the central pick-up rod 12 has a series of evenly spaced selector holes. The selector holes are designed to align with the selector pin holes 48 located at the side of each weight plate 24. Due to manufacturing tolerances of the weight plate 24, which are usually made from cast iron, the respective holes in each part often do not align. Thus, selector pin 18 cannot be inserted easily according to conventional design.

In the present invention, however, the slot opening 36 provides a vertical adjustment capability for the central pick-up rod 12 in that the locking bolt 38 can be shifted in place vertically. As shown in FIG. 1, for example, if the selector pin hole 48 of the seventh weight plate 58 does not align with the corresponding pick-up rod selector hole, sliding the central pick-up rod 12 vertically relative to seventh weight plate 58 eventually aligns the respective holes. The selector pin 18 then can be inserted. The key to easy assembly is thus the ability of the locking bolt 38, which interlocks the top weight 20 to the central pick-up rod 12, to shift vertically along slot opening 36. With the benefit of the vertical adjustment feature as provided by the slot opening 36, the present invention top weight 20 can be adapted to numerous weight stack configurations, various central pick-up rod lengths, and even weight machines of different design.

It is recognized that the above-described invention may be embodied in other specific forms without departing from the spirit or essential characteristics of the disclosure. Thus, it is understood that the present invention is not to be limited by the foregoing illustrative details.

What is claimed is:

1. A top weight disposed at a top of a weight stack in a suspended weight exercise machine having guide rods on which the weight stack slides, and a central pick-up rod which engages the weight stack for suspension thereof, the top weight comprising:

a body having opposed side walls wherein each side wall includes a vertically elongated opening therethrough, a plurality of open cavities, a centrally located sleeve for receiving the pick-up rod, extending vertically through the center of the body, and two bearing tubes disposed in the open cavities on opposite sides of the centrally located sleeve and extending vertically therethrough in a substantially parallel orientation, adapted to slidably engage the guide rods; and insert weight plates disposed in the open cavities on opposite sides of the centrally located sleeve, each insert weight plate having a slot therethrough, wherein the slots in the insert weight plates and the slots in the side walls are substantially aligned and in communication with a hole in the pick-up rod.

2. A top weight according to claim 1, wherein the top weight further comprises additional weight plates adapted for insertion into the plurality of open cavities, whereby an overall weight of the top weight can be increased incrementally, and adding additional insert weight plates to each open chamber adjusts a weight distribution of the top weight.

3. A top weight according to claim 2, wherein each insert weight plate has a rectangular shape.

4. A top weight according to claim 3, wherein the overall weight ranges from 5 to 8 lbs.

5. A top weight according to claim 4, wherein the body is molded from a polymer.

6. A top weight according to claim 5, wherein the insert weight plates are made from steel.

7. A top weight disposed at a top of a weight stack in a suspended weight exercise machine having guide rods on which the weight stack slides, and a central pick-up rod having a hole therethrough, the top weight comprising:

a body having two bulbous sections interconnected by an intermediate portion defining a top, a bottom and opposed side walls, wherein each opposed walls has a slot opening therein, a plurality of open cavities inside the body in communication with an exterior of the body at the bottom, a centrally located sleeve disposed in the intermediate portion extending vertically, the centrally located sleeve adapted to receive the central pick-up rod, two bearing tubes each disposed in the respective bulbous section extending vertically, wherein each bearing tube is adapted to slide on the respective guide rod, and a pair of insert weight plates disposed on opposing sides of the centrally located sleeve, wherein each insert weight plate has a slot opening therein, wherein the slot openings in the walls and insert weight plates and the hole in the pick-up rod are substantially aligned and in communication; and a pin, disposed through the aligned slot openings and hole in the pick-up rod.

8. A method of adjusting a top weight during assembly to a suspended weight exercise machine having a cable and pulley system for lifting a weight stack, wherein the top weight is disposed at a top of the weight stack of the suspended weight exercise machine having guide rods on which the weight stack slides, and a central pick-up rod having a hole therethrough, the method of adjusting the top weight comprising the steps of:

providing a top weight body having opposed side walls wherein each wall includes a slot opening therethrough, a plurality of open cavities, a centrally located sleeve for receiving the pick-up rod, extending vertically through the center of the body, and two bearing tubes disposed on opposite sides of the centrally located sleeve and extending vertically through the body in a substantially parallel orientation, adapted to slidably engage the guide rods;

providing a plurality of insert weight plates of varying weights adapted to be disposed in the open cavities on opposite sides of the centrally located tube, each insert weight plate having a slot therethrough;

selecting at least one weight plate to counterbalance a portion of the cable and pulley system;

inserting the selected weight plate into one of the open cavities;

aligning the slots of the insert weight plates and the slots of the side walls with a hole in the pick-up rod;

inserting a locking member through the aligned slots of the insert weight plates and the side walls, and the hole in the central pick-up rod; and sliding the locking member along the slots of the insert weight plates and the slots of the side walls to align a selector hole in the central pick-up rod with a corresponding selector hole in the weight stack, whereby a position of the top weight is adjusted relative to the selector hole of the weight stack.

* * * * *